US011767202B2

(12) United States Patent
Lupi et al.

(10) Patent No.: US 11,767,202 B2
(45) Date of Patent: Sep. 26, 2023

(54) TRANSPORTABLE LIFTING DEVICE

(71) Applicant: FIN GROUP S.R.L., Bergamo (IT)

(72) Inventors: Giuseppe Lupi, Bergamo (IT); Stefano Duci, Urgnano (IT); Andrea Mazzoleni, Alme' (IT)

(73) Assignee: FIN GROUP S.R.L., Bergamo (IT)

( * ) Notice: Subject to any disclaimer, the term of this patent is extended or adjusted under 35 U.S.C. 154(b) by 611 days.

(21) Appl. No.: 16/846,018

(22) Filed: Apr. 10, 2020

(65) Prior Publication Data

US 2020/0325007 A1 Oct. 15, 2020

(30) Foreign Application Priority Data

Apr. 15, 2019 (IT) ..... 102019000005782

(51) Int. Cl.

| | |
|---|---|
| ***B66F 1/00*** | (2006.01) |
| ***B66F 11/04*** | (2006.01) |
| ***E04H 12/10*** | (2006.01) |
| ***B66C 23/68*** | (2006.01) |
| ***B66C 23/48*** | (2006.01) |
| ***B66F 19/00*** | (2006.01) |

(52) U.S. Cl.

CPC ..... *B66F 1/00* (2013.01); *B66C 23/48* (2013.01); *B66C 23/68* (2013.01); *B66F 11/04* (2013.01); *E04H 12/10* (2013.01); *B66F 19/00* (2013.01)

(58) Field of Classification Search

CPC ..... B66F 1/00; B66F 5/00; B66F 5/02; B66F 7/06; B66F 7/0625; B66F 9/065; B66F 11/04; B66F 19/00; B66C 23/022; B66C 23/28; B66C 23/365; B66C 23/48; B66C 23/485; B66C 23/68; B66C 23/70; B66C 23/166; E04H 12/10; B62B 2203/10; B62B 2203/11; A62B 1/00; A62B 1/06; A62B 1/08; A62B 1/10

USPC ..... 254/105; 248/235–246; 340/685

See application file for complete search history.

(56) References Cited

U.S. PATENT DOCUMENTS

| | | | | |
|---|---|---|---|---|
| 73,657 A * | 1/1868 | Shopbell | B66F 15/00 | 254/120 |
| 244,732 A | 7/1881 | Bland | | |
| 254,941 A * | 3/1882 | Duval | B66C 23/20 | 212/200 |
| 732,584 A * | 6/1903 | Pierce | E04G 5/06 | 248/240.3 |

(Continued)

FOREIGN PATENT DOCUMENTS

EP 0974546 A1 1/2000

*Primary Examiner* — Mahdi H Nejad
*Assistant Examiner* — Jacob Adam Montgomery
(74) *Attorney, Agent, or Firm* — Dickinson Wright PLLC; Andrew D. Dorisio

(57) ABSTRACT

A transportable lifting device (10) comprising: an upright (12); an arm (13) connectable to the upper end of said upright (12); a diagonal (14) for connecting said arm (13) and said upright (12); characterized in that said arm (13) is fixed to said upright (12) by means of a first joint (30, 35); said diagonal (14) is fixed to said upright (12) by means of a second joint (32, 41); said diagonal (14) is fixed to said arm (13) by means of a third joint (36, 40); said first joint (30, 35), said second joint (32, 41) and said third joint (36, 40) are of the type with double tenon and mortise; said first joint (30, 35) comprises: two hooks (35) placed at the end of the arm (13); two vertical slots (30) placed on the upright (12).

15 Claims, 7 Drawing Sheets

(56) References Cited

U.S. PATENT DOCUMENTS

| | | | | | |
|---|---|---|---|---|---|
| 1,868,508 | A * | 7/1932 | Stewart | F16B 7/22 | 254/134.7 |
| 2,485,685 | A * | 10/1949 | Armstrong | E06C 7/16 | 248/210 |
| 2,665,952 | A * | 1/1954 | Edwards | E06C 7/16 | 182/122 |
| 3,521,860 | A * | 7/1970 | Zehrung, Jr. | B66C 23/48 | 212/175 |
| 4,496,262 | A * | 1/1985 | Sangster | F16B 5/07 | 403/336 |
| 5,199,586 | A * | 4/1993 | Pech | B66C 23/70 | 212/175 |
| 5,211,297 | A * | 5/1993 | Vandervalk | B66C 23/42 | 212/231 |
| 5,431,526 | A | 7/1995 | Peterson et al. | | |
| 7,377,740 | B2 * | 5/2008 | Panzarella | B60P 1/5433 | 212/180 |
| 7,954,657 | B2 * | 6/2011 | Holly | B66C 23/70 | 212/177 |
| 2008/0053751 | A1 * | 3/2008 | Meyers | E06C 7/16 | 182/121 |
| 2008/0156585 | A1 * | 7/2008 | Pyktel | E06C 7/46 | 182/108 |
| 2011/0053482 | A1 | 3/2011 | McKenzie | | |

* cited by examiner

TRANSPORTABLE LIFTING DEVICE

This application claims the benefit of Italian Patent Application 102019000005782, filed Apr. 15, 2019, the disclosure of which is incorporated herein by reference.

Technical Field

The present invention relates to a transportable lifting device.

BACKGROUND

In particular, it relates to a modular and transportable lifting device.

More in particular, it relates to a device for protection against falls from height specifically designed for all those situations in which one or more operators require access to confined spaces or when the operator requires access to the work area by being lowered, with or without the aid of peg ladders.

Small cranes or aluminium tripods that perform the same function are present on the market. Although transportable, these are generally modular devices formed of various elements or bulky devices.

The solutions present on the market generally use systems that make use of spring pins, screws or other systems for the assembly and placing into service of the device, which must subsequently be removed.

This procedure is critical for a series of factors, or the small components could be lost during use. Moreover, the operations for mounting and use are complex and require more than one person.

Instead, with regard to transportability, devices available on the market generally consist of several parts that are then assembled or that are closed in order to be transported, but without actually reducing the dimensions of the components.

SUMMARY

The aim of the present invention is to provide a transportable lifting device that does not occupy a large amount of space during transport.

Another aim is to provide a device that is simple to mount.

A further aim is to provide a device that is formed of only a few components.

In accordance with the present invention, these aims and yet still are achieved by a transportable lifting device comprising: an upright; an arm connectable to the upper end of said upright; a diagonal for connecting said arm and said upright; characterized in that said arm is fixed to said upright by means of a first joint; said diagonal is fixed to said upright by means of a second joint; said diagonal is fixed to said arm by means of a third joint; said first joint, said second joint and said third joint are of the double tenon and mortise type; said first joint comprises: two hooks placed at the end of the arm; two vertical slots placed on the upright.

Further features of the invention are described in the dependent claims.

The advantages of this solution relative to the prior art solutions are several.

In accordance with the present invention, the lifting device, in the rest position for transport, is located completely inside the upright.

It is easily mounted by means of three joints and does not require other parts for mounting and to guarantee the safety of the device during use. In fact, no fixing pins are used.

The joint allows one part to be inserted into another body so that it remains secured integrally therein without the use of pins.

The joints are of the male and female type and in particular of the double tenon and mortise type. No other locking parts are required to hold the device.

BRIEF DESCRIPTION OF DRAWINGS

The features and the advantages of the present invention will be apparent from the following detailed description of a practical embodiment thereof, illustrated by way of non-limiting example in the accompanying drawings, wherein.

DETAILED DESCRIPTION

Figure 1:
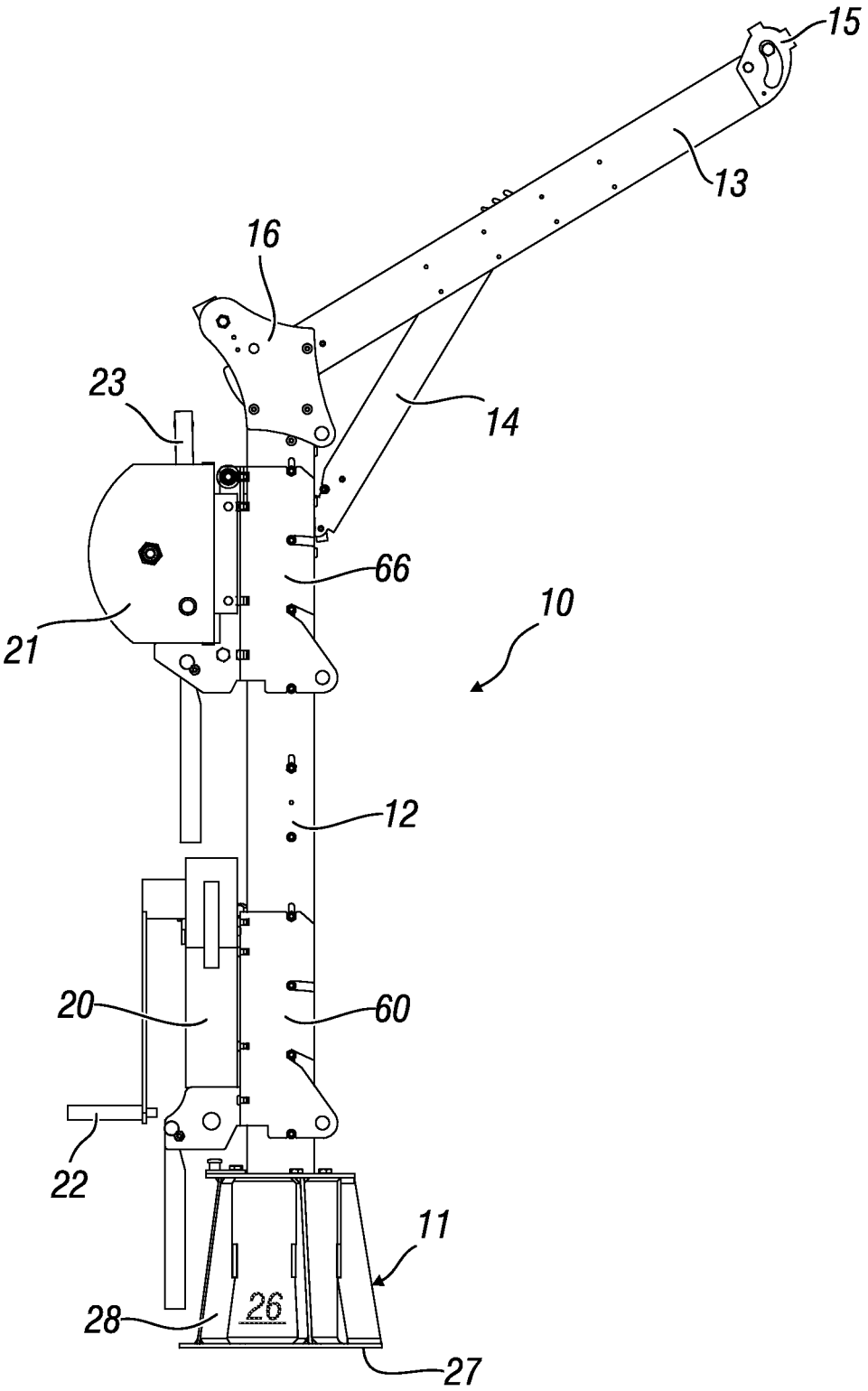
FIG. 1 schematically shows a transportable lifting device, in a position of use, in accordance with the present invention.

With reference to the accompanying figures, a transportable lifting device 10, in accordance with the present invention, comprises a base 11 to be fixed to the ground, engaging on which is an upright 12 that extends vertically. A sub horizontal arm 13, supported at the centre by a diagonal 14 connected to the upright 12, is connected at the upper end of the upright.

The arm 13 comprises a head 15 carrying two adjacent pulleys at its end.

A pair of plates 16 that carry two adjacent pulleys is placed in the joint between the upright 12 and the arm 13A.

The device 10 further comprises first and second devices 20 and 21 for controlling the safety cables placed on the upright 12.

The first device 20, placed under the second device 21, is a winch that can be operated manually by means of a handle 22. It controls a cable (not shown) that passes beyond the second device 21, through a pulley of the plates 16 and through one of the pulleys of the head 15 and is then connected to the user.

The second device 21 can be operated manually by means of a handle 23 and controls a safety cable (not shown) that passes through a pulley of the plates 16 and through one of the pulleys of the head 15 and is then connected to the user.

The base 11 comprises a pipe 26 having a lower flange 27 with holes for fixing it to the ground, and preferably, five vertical struts 28 placed at an angle to the pipe 26 and produced with plates.

At the top it has an upper flange 29 with a plurality of holes along its extension.

The upright 12 is a profile having a square section with a side of approximately 10 cm that comprises in proximity of its tip, namely, at 10 cm from its end, on the outer side thereof, two vertical slots 30 (double mortise) spaced apart by approximately 7 cm and approximately 10 cm in length.

The inner side of the upright 12 has at the tip a substantially square groove 31, with a side of 7 cm, and under this it has two slots 32 (double mortise) placed at approximately 30 cm from the end of the upright and side-by-side at a distance of 4 cm, each having an upper square enlargement.

The arm 13 is a profile having a U-shaped section with a side of approximately 7 cm that, at one end, has the head 15 formed by the extension the two sides of the U, inside of which the two head pulleys are fixed and, at the other end, the lateral sides of the U extend to form two hooks 35 (double tenon) in the shape of a seven.

Approximately halfway along its length, the arm 13 comprises two series of parallel holes 36 (double mortise) spaced apart by approximately 4 cm.

The diagonal 14 is a profile having a U-shaped section with a side of approximately 4 cm that, at one end, has a pair of three parallel rods. The rods extend from the two lateral sides of the U to form a triple hook 40 (double tenon), and, at the other end, the sides of the U each form a hook 41 (double tenon) in the shape of a semi-circle with a recess 42.

For the hook 40 only one rod per side could be sufficient to fix the arm, but to make it sturdier more than one is used, and in this particular case three are used.

In an embodiment, the upright 12 has a length of approximately 180 cm, the arm 13 has a length of approximately 130 cm and the diagonal 14 has a length of approximately 100 cm.

A pair of guides 43, one per side, is fixed inside the upper end of the upright 12, each produced by means of a plate bolted internally to the upright 12, which has a vertical channel 44 open at the bottom. It has a first 180° bend 45 at the top and, preferably, a second 90° bend 46 at the end towards the inside of the device 10.

Inside the guide 43, a circular PTFE bushing 48 can slide, which is fixed in proximity of (approximately 10-20 cm from) the inner (lower) end of the arm 13.

A pair of guides 50, one per side, is fixed in a central position inside the arm 13, each produced by means of a plate bolted internally to the arm 13, which has a rectilinear guide 51, having at the lower end thereof a series (in the figures three are present) of adjustment positions 52.

Inside the guide 50, a circular PTFE bushing 53 can slide, which is fixed in proximity of (approximately 10-20 cm from) the outer portion of the diagonal 14.

Figure 2:
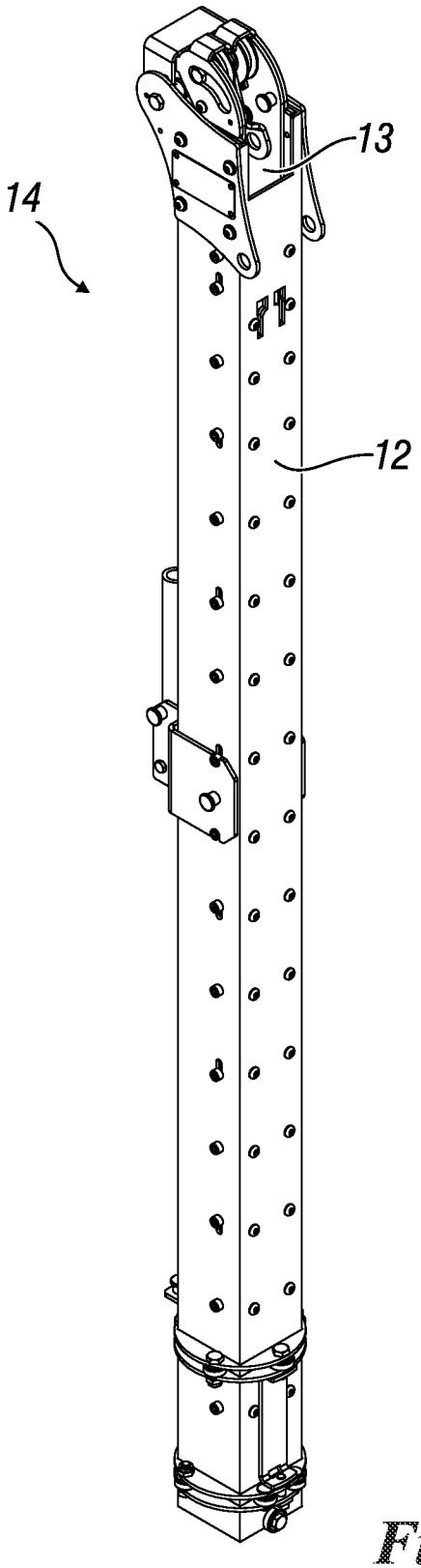
FIG. 2 schematically shows a transportable lifting device, in a transport position, in accordance with the present invention.
Figure 3:
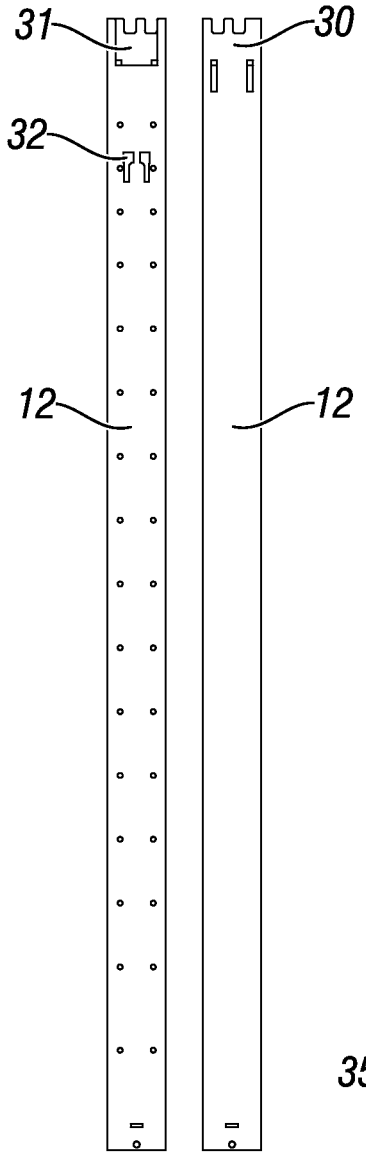
FIG. 3 schematically shows an upright of a transportable lifting device, in a front and in a rear view, in accordance with the present invention.
Figure 4:
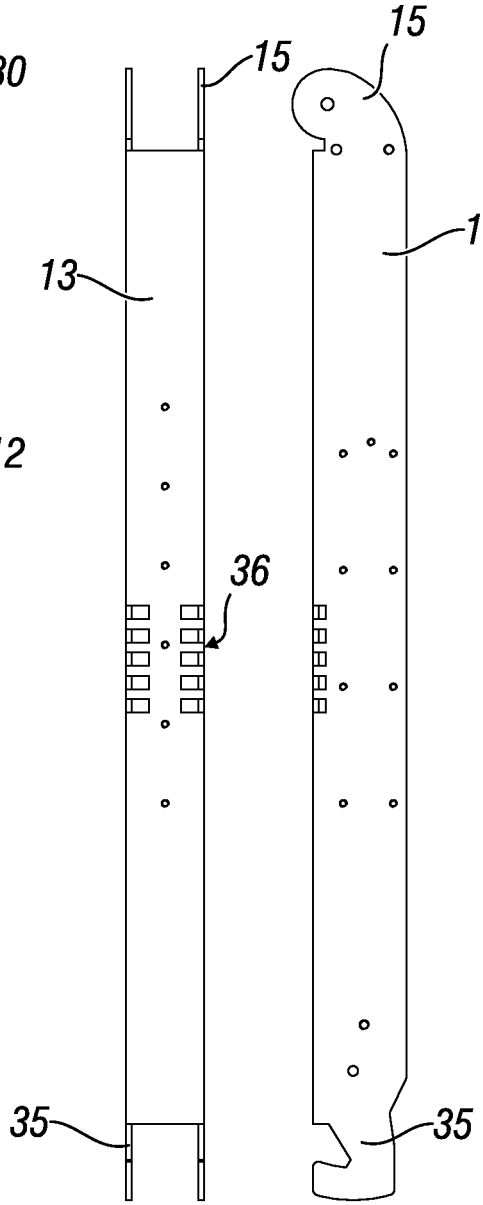
FIG. 4 schematically shows an arm of a transportable lifting device, in a front and in a side view, in accordance with the present invention.
Figure 5:
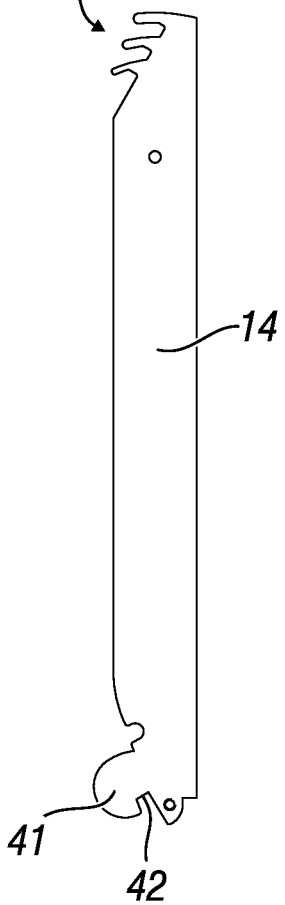
FIG. 5 schematically shows a diagonal of a transportable lifting device, in a side view, in accordance with the present invention.
Figure 6:
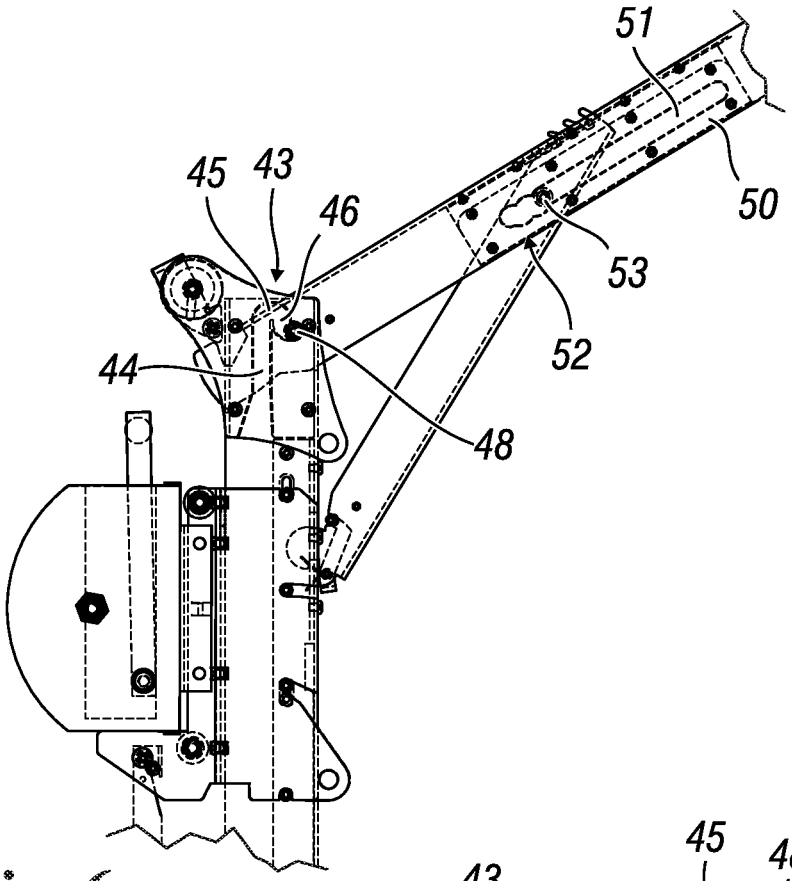
FIG. 6 schematically shows a joining portion between upright, arm and diagonal of a transportable lifting device, in a side and transparent view, in accordance with the present invention.
Figure 7:
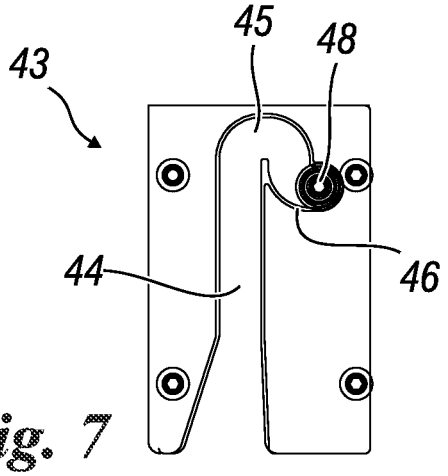
FIG. 7 schematically shows a first guide of a transportable lifting device in accordance with the present invention.
Figure 8:
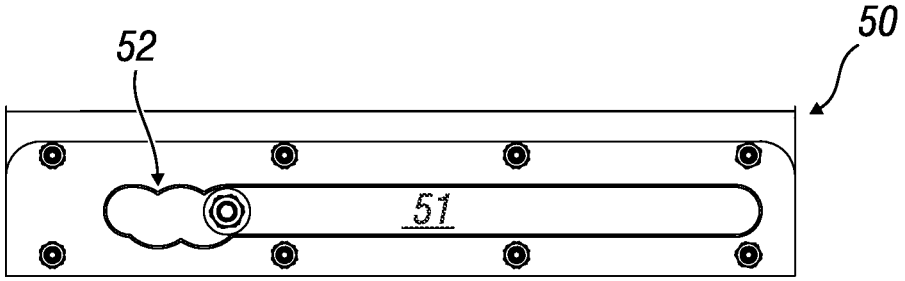
FIG. 8 schematically shows a second guide of a transportable lifting device in accordance with the present invention.
Figure 9A:
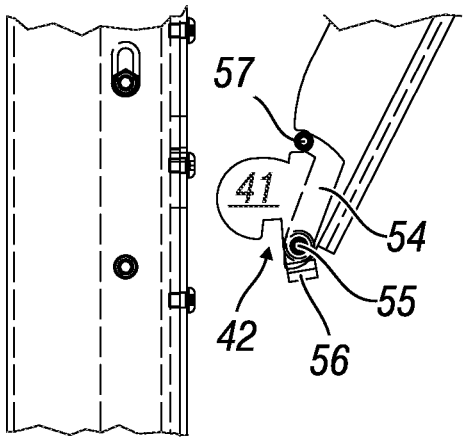
FIGS. 9*a*, 9*b* and 9*c* schematically show a coupling system that couples to the upright of the diagonal of a transportable lifting device, respectively in three coupling steps, in accordance with the present invention.
Figure 9B:
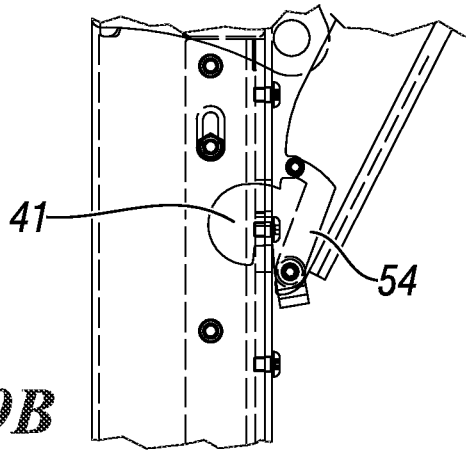
Figure 9C:
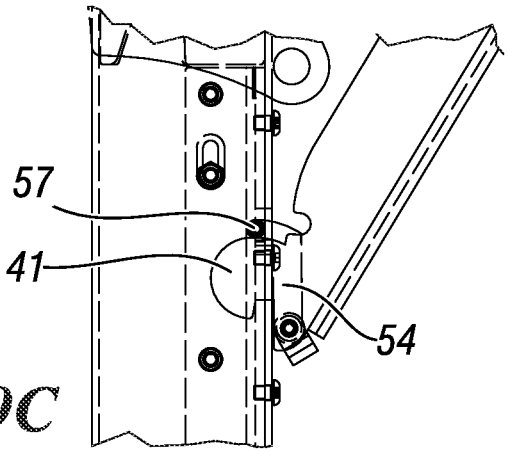
Figure 10A:
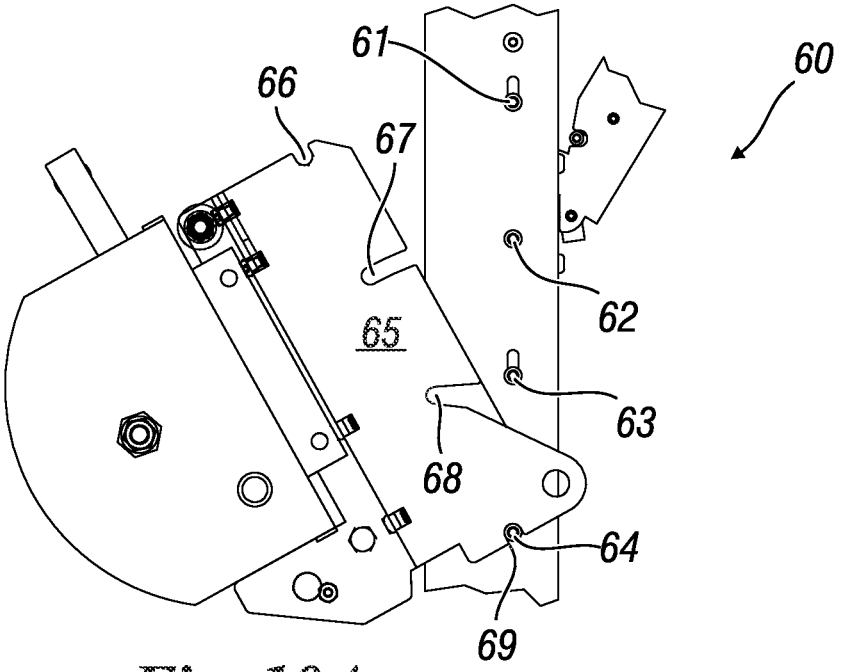
FIGS. 10*a* and 10*b* schematically show a fixing system that fixes to an upright of first and second devices for controlling the safety cables of a transportable lifting device, respectively in the coupling step and coupled in accordance with the present invention.
Figure 10B:
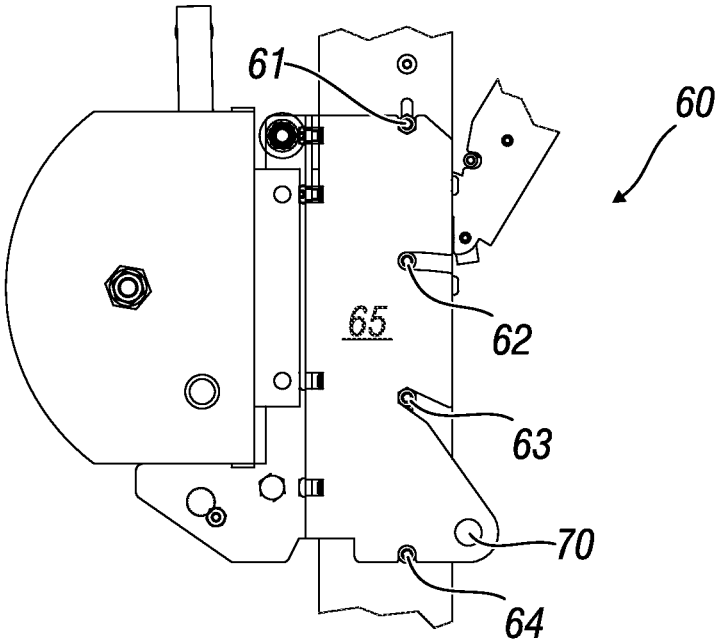
Figure 11A:
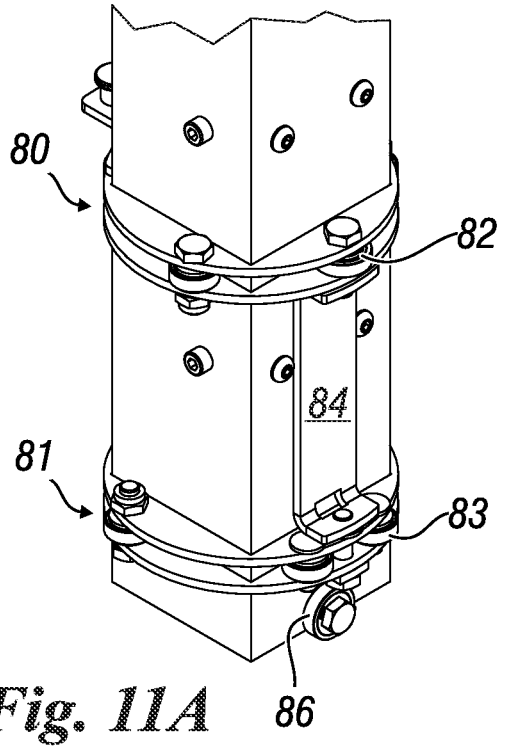
FIGS. 11*a* and 11*b* schematically show a rotation system of an upright relative to a base, of a transportable lifting device, respectively in a perspective and in a side view, in accordance with the present invention.
Figure 11B:
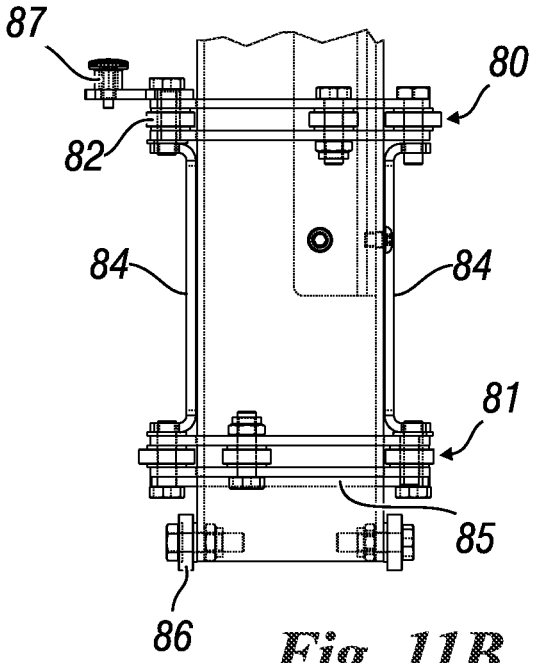
Figure 12:
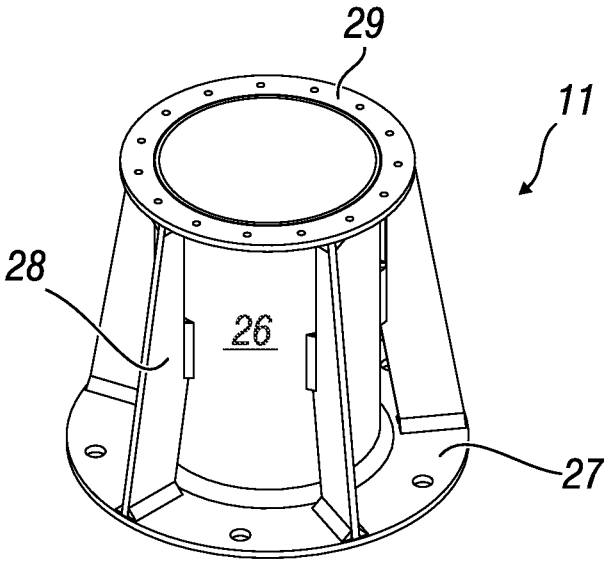
FIG. 12 schematically shows a base of a transportable lifting device, in accordance with the present invention.

The transportable lifting device 10 in the rest and transport position is in the configuration shown in FIG. 2.

The diagonal 14 (side of 4 cm) is inside the arm 13 (side of 7 cm), which in turn is inside the upright 12 (side of 10 cm).

During manufacture of the device 10, before sale, the pairs of bushings 53 are mounted, one per side, by means of a pin (bolt) on the diagonal 14. The bushings 53 are positioned inside the guides 51 and the plates in which the guides 50 are located are mounted inside the arm 13, by means of the special bolts. Consequently, the diagonal 14 is connected movably to the arm 13.

The bushing 53 is made to slide along the guide 51 and the diagonal 14 is inserted into the arm 13.

The bushings 48 are mounted to the arm 13 and is inserted inside the upright 12 and the plates in which the guides 42 are located are mounted by means of special bolts.

To set up the device 10 the assembly composed of the arm 13 and of the diagonal 14 is inserted upward from the upright 12 until the bushing 48 slides in the vertical channel 44, passes into the bend 45 and, lowering the arm 13, the bushing 48 is positioned inside the bend 46. The assembly composed of the arm 13 and of the diagonal 14 is now supported vertically on the upright 12.

The lower part of the diagonal 14, which is currently supported inside the base of the arm 13, is extracted from the arm 13 and is lowered so that the bushing 53 is positioned in one of the adjustment positions 52 provided and the triple hook 40 is pushed into the two series of holes 36 present on the arm 13.

As there are several holes 36 it is possible to choose different configurations thereby changing the inclination of the arm 13.

At this point the arm 13 is inclined, due to the space of the groove 31, and the two hooks 35 of the arm 13 are hooked through the two vertical slots 30 of the upright 12.

The hooks 41, of the diagonal 14, are inserted into the two slots 32 of the upright 12, the hooks 41 are lowered and the recess 42 is positioned on the edge of the upright 12.

In particular, the hooks 41 preferably comprise a lever 54 pivoted upstream of the recess 42 with a pin 55. Below the pin 55 the lever extends to form a button 56 for movement of the lever that extends above the pin 55 and ends with a pair of pins 57 arranged spaced apart from each other and transverse to the lever 54, which are inserted into the enlargement of the two slots 32, so as to secure the diagonal 14 to the upright 12 reducing the space required by the diagonal 14 to exit its seat.

To separate the diagonal 14 from the upright 12, the button 56 is pressed to rotate the lever 54 outwards and thereby cause the pins 57 to exit the seat allowing the hooks 41 to exit the slots 32.

The first and second devices 20 and 21 for controlling the safety cables comprise fixing means 60 on the upright 12.

On the upright four bushings are present, per side, aligned vertically.

The first 61 and the third 63 bushings, starting from the top, can slide along a respective vertical slot placed on said upright 12.

The second 62 and the fourth 64 bushings are fixed starting from the top.

The fixing means 60 comprise pairs of lateral plates 65 that extend at the rear from the first and second devices 20 and 21, and integral therewith.

Each plate 65 has an upper vertical slot 66, a horizontal slot 67 placed below the upper slot 66, a countersunk slot 68 inclined upwards by approximately 45°, placed below the slot 67, and a lower vertical slot 69.

The four slots 66-69 are designed to cooperate with the respective four bushings 61-64.

Each plate 65 comprises a hole 70 which, when mounted, extends beyond the upright 12, which is used as anchor point of the crane operator.

To fix the devices 20 and 21 to the upright 12, only three bushings would be sufficient: the first 61, the second 62 and the fourth 64 bushings, and the corresponding upper 66, 67 and lower 69 slots.

The first bushing 61 prevents rotation and horizontal translation, the fourth bushing 64 prevents the bracket from translating downwards and the second bushing 62 prevents the bracket from translating upwards (translation already partly limited by the presence of the first sliding bushing 61). However, for greater stability four bushings and four slots are used.

Moreover, if an alternated series of bushings (fixed and sliding) are provided on the upright, the operator can choose at what height to position the device.

To hook the devices 20 and 21 to the upright 12, the lower vertical slot 69 is placed against the fourth fixed bushing 64, the lowest one, the device is rotated around this bushing moving it closer towards the upright 12. The bushing 63 is moved in its slot to enter the countersunk slot 68. The fixed bushing 62 is inserted into the horizontal slot 67 and the upper vertical slot 66, which has a guiding surface on the front (on the plate 65), moves the sliding bushing 61 which is raised, by means of the guiding surface, and then falls into the upper vertical slot 66, holding the device on the upright. At this point, the device is fixed to the upright 12 and locked thereon.

To detach the device from the upright 12, it is sufficient to lift the first bushing 61 from the slot 66 and the device can rotate around the bushing 64 and detach from the upright 12.

The devices 20 and 21 are in this case devices for controlling and managing the safety cables, but the fixing means 60 can be used for any device that must be fixed to a vertical upright.

To obtain rotation of the upright 12 around its vertical axis, bearings that rotate around a vertical axis and bearings that rotate around a horizontal axis are mounted at its base.

Two pairs of circular plates, one upper 80 and one lower 81, have been provided fixed to the upright.

Alternatively to the use of a pair of plates, which give the structure greater stability, only one plate could be used.

Five upper 82 and lower 83 bearings are placed between each pair of plates, project from the plates, retained by vertical bolts, and therefore the bearings 82 and 83 rotate about a vertical axis.

The bearings 82 and 83 are arranged so that they occupy the vertices of a five-pointed star.

The upper bearings 82 are placed staggered relative to the lower bearings 83, i.e. are placed on parallel vertical axes.

The two pairs of plates 80 and 81 are connected to each other by two further vertical plates 84 bent at the ends, and lateral to the two sides of the upright 12.

The two pairs of plates 80 and 81 are fixed to the upright 12 by means of a through plate 85 inside of the upright 12.

The bearings 82 and 83 are positioned so as to cooperate with the inside of the circular pipe 26 of the base 11, and maintain the verticality of the upright 12.

The positioning of the bearings 82 and 83 is implemented so that the circumference tangent to the bearings is substantially the same as the inner diameter of the pipe 26.

To rotate the upright 12 another two bearings 86 are also fixed, placed in vertical position and fixed to the lower end of the upright 12 by means of horizontally arranged bolts, so that the bearings 86 project from the lower end of the upright 12 and can rotate around a horizontal axis.

The bearings 86 are placed in proximity of the outer edges of the upright, one in front of the other (arranged at 180° from one another).

A problem of the rotation lies in eliminating as much as possible the clearance between rotation system and fixed base 11, to prevent undesired movements of the upright during use. This clearance cannot be completely eliminated as the pipe 26 used to produce the base, although commercial, is an electro welded pipe with tolerances inherent to its manufacture. Moreover, to facilitate the insertion of the upright 12 into the base 11 there must be a minimum tolerance to avoid making the operation difficult. Added to these tolerances are defects occurring during welding of the various reinforcement components, which deform the pipe 26 of the support. These defects have been reduced through two solutions: the first consists in welding the struts 28 only in the areas in which the bearings are not in contact with the pipe. In this way, the pipe 26 should remain unchanged in the areas in which the bearings slide. The second solution consists of arranging the bearings so that two are never opposite (at 180° from one another) on the same diameter so as to once again reduce any manufacturing defects. In particular, a layout of the bearings that satisfies this requirement is the arrangement of the bearings at the vertices of a five-pointed star. Another layout that satisfies this requirement is that of using three bearings arranged at the vertices of a triangle.

A knob 87 with a vertical spring, is placed on the upper plate of the pair of upper plates 80, on the bottom of which is a pin that is inserted into one of the holes present on the flange 29 to block rotation of the device 10.

The material used for the device 10, which in this case is steel, and the dimensions, can be any according to requirements and to the state of the art.

Many modifications and variants can be made to the device thus conceived, all falling within the scope of the inventive concept; moreover, all details can be replaced by technically equivalent elements.

The invention claimed is:

1. A crane (10) comprising: an upright (12); an arm (13) connectable to an upper end of said upright (12); a diagonal (14) for connecting said arm (13) and said upright (12); wherein said arm (13) is fixed to said upright (12) by means of a first joint (30, 35); said diagonal (14) is fixed to said upright (12) by means of a second joint (32, 41); said diagonal (14) is fixed to said arm (13) by means of a third joint (36, 40); said first joint (30, 35), said second joint (32, 41) and said third joint (36, 40) are of a double tenon and mortise type; said first joint (30, 35) comprises: two hooks (35) placed at the end of the arm (13); two vertical slots (30) placed on the upright (12), said first joint (30, 35) comprises: a pair of guides (43) placed at the upper end of the upright (12); said pair of guides (43) comprises a vertical channel (44) open at the bottom, which has a first 180° bend (45) at the top; inside each of said pair of guides (43) a bushing (48) can slide, which is fixed in proximity of an inner end of the arm (13), and said first joint (30, 35) comprises: a second 90° bend (46) arranged towards the inside of the device (10), and after said first bend.

2. The crane in accordance with claim 1, wherein said second joint (32, 41) comprises: a pair of hooks (41) placed at one end of the diagonal (14); two slots (32) placed on the upright (12).

3. The crane in accordance with claim 2, wherein said second joint (32, 41) comprises: a lever (54) pivoted on said diagonal (14) having a button (56) at the bottom and a pair of pins (57) at the top, arranged spaced apart from each other and transverse to the lever (54) that is inserted into an upper enlargement of the two slots (32).

4. The crane in accordance with claim 1, wherein said third joint (36, 40) comprises: a hook (40) placed at one end of said diagonal (14); two series of parallel holes (36) present on the arm (13).

5. The crane in accordance with claim 4, wherein said third joint (36, 40) comprises: a pair of guides (50), one per side, placed at the centre of the arm (13), comprising a rectilinear guide (51), having at its lower end a series of adjustment positions (52); a circular bushing (53), fixed on the diagonal (14), can slide inside the guide (51).

6. The crane in accordance with claim 1, wherein in both the rest position and the transport position the diagonal (14) is inside the arm (13) which is in turn located inside the upright (12).

7. The crane in accordance with claim 1, further comprising: a base comprising a pipe having a lower flange with holes configured for fixing the base to the ground, wherein the upright is fixed.

8. A crane (10) comprising: an upright (12); an arm (13) connectable to an upper end of said upright (12); a diagonal (14) for connecting said arm (13) and said upright (12); wherein said arm (13) is fixed to said upright (12) by means of a first joint (30, 35); said diagonal (14) is fixed to said upright (12) by means of a second joint (32, 41); said diagonal (14) is fixed to said arm (13) by means of a third joint (36, 40); said first joint (30, 35), said second joint (32, 41) and said third joint (36, 40) are of a double tenon and mortise type; said first joint (30, 35) comprises: two hooks (35) placed at the end of the arm (13); two vertical slots (30) placed on the upright (12), wherein said second joint (32, 41) comprises: a pair of hooks (41) placed at one end of the diagonal (14); two slots (32) placed on the upright (12); and a lever (54) pivoted on said diagonal (14) having a button (56) at the bottom and a pair of pins (57) at the top, arranged spaced apart from each other and transverse to the lever (54) that is inserted into an upper enlargement of the two slots (32).

9. The crane in accordance with claim 8, wherein said third joint (36, 40) comprises: a hook (40) placed at one end of said diagonal (14); two series of parallel holes (36) present on the arm (13).

10. The crane in accordance with claim 9, wherein said third joint (36, 40) comprises: a pair of guides (50), one per side, placed at the centre of the arm (13), comprising a rectilinear guide (51), having at its lower end a series of adjustment positions (52); a circular bushing (53), fixed on the diagonal (14), can slide inside the guide (51).

11. The crane in accordance with claim 8, wherein in both the rest position and the transport position the diagonal (14) is inside the arm (13) which is in turn located inside the upright (12).

12. A crane (10) comprising: an upright (12); an arm (13) connectable to an upper end of said upright (12); a diagonal (14) for connecting said arm (13) and said upright (12); wherein said arm (13) is fixed to said upright (12) by means of a first joint (30, 35); said diagonal (14) is fixed to said upright (12) by means of a second joint (32, 41); said diagonal (14) is fixed to said arm (13) by means of a third joint (36, 40); said first joint (30, 35), said second joint (32, 41) and said third joint (36, 40) are of a double tenon and mortise type; said first joint (30, 35) comprises: two hooks (35) placed at the end of the arm (13); two vertical slots (30) placed on the upright (12), and said third joint (36, 40) comprises: a hook (40) placed at one end of said diagonal (14); two series of parallel holes (36) present on the arm (13).

13. The crane in accordance with claim 12, wherein said third joint (36, 40) comprises: a pair of guides (50), one per side, placed at the centre of the arm (13), comprising a rectilinear guide (51), having at its lower end a series of adjustment positions (52); a circular bushing (53), fixed on the diagonal (14), can slide inside the guide (51).

14. The crane in accordance with claim 12, wherein in both the rest position and the transport position the diagonal (14) is inside the arm (13) which is in turn located inside the upright (12).

15. The crane in accordance with claim 12, further comprising: a base comprising a pipe having a lower flange with holes configured for fixing the base to the ground, wherein the upright is fixed.

* * * * *